US006892622B2

(12) United States Patent
Watson

(10) Patent No.: US 6,892,622 B2
(45) Date of Patent: May 17, 2005

(54) ANTI-MINE UNIT

(76) Inventor: John E. Watson, 60365 Somerton Rd., Barnesville, OH (US) 43713

( * ) Notice: Subject to any disclaimer, the term of this patent is extended or adjusted under 35 U.S.C. 154(b) by 108 days.

(21) Appl. No.: 10/636,651

(22) Filed: Aug. 8, 2003

(65) Prior Publication Data

US 2004/0050558 A1 Mar. 18, 2004

Related U.S. Application Data

(60) Provisional application No. 60/402,546, filed on Aug. 12, 2002.

(51) Int. Cl.[7] ..... F41H 11/12

(52) U.S. Cl. ..... 89/1.13; 102/402

(58) Field of Search ..... 102/402; 89/1.13; 172/45

(56) References Cited

U.S. PATENT DOCUMENTS

| | | | | | |
|---|---|---|---|---|---|
| 655,584 | A | | 8/1900 | Schwartz | |
| 731,146 | A | | 6/1903 | Wilmeth | |
| 1,102,326 | A | | 7/1914 | Dalsing | |
| 1,679,628 | A | | 8/1928 | Roby | |
| 2,320,986 | A | * | 6/1943 | Redmond | 114/221 R |
| 2,425,357 | A | * | 8/1947 | Brooks | 89/1.13 |
| 2,489,564 | A | * | 11/1949 | Du Toit | 89/1.13 |
| 2,496,423 | A | * | 2/1950 | Taylor | 89/1.13 |
| 2,920,405 | A | | 1/1960 | Cole | |
| 2,964,863 | A | | 12/1960 | Shepherd | |
| 3,260,003 | A | | 7/1966 | Rolfe | |
| 3,416,403 | A | * | 12/1968 | Smith | 89/1.13 |
| 4,593,766 | A | | 6/1986 | Gossard | |
| 4,667,564 | A | * | 5/1987 | Schreckenberg | 89/1.13 |
| 4,765,221 | A | * | 8/1988 | Sombrowski | 89/1.13 |
| 4,862,969 | A | * | 9/1989 | Jobst et al. | 172/45 |
| 4,987,819 | A | * | 1/1991 | Brown | 89/1.13 |
| 5,007,325 | A | * | 4/1991 | MacWatt | 89/1.13 |
| 5,183,119 | A | | 2/1993 | Wattenburg | |
| 5,856,629 | A | * | 1/1999 | Grosch et al. | 89/1.13 |
| 5,869,967 | A | * | 2/1999 | Straus | 324/326 |
| 5,979,289 | A | * | 11/1999 | French | 89/1.13 |
| 6,330,920 | B1 | | 12/2001 | Wanner | |
| 6,520,062 | B1 | * | 2/2003 | Laine et al. | 89/1.13 |
| 6,619,177 | B1 | * | 9/2003 | Hansen et al. | 89/1.13 |
| 2003/0196543 | A1 | * | 10/2003 | Moser et al. | 89/1.13 |

FOREIGN PATENT DOCUMENTS

| | | | | |
|---|---|---|---|---|
| WO | WO93/11402 | | 6/1993 | |
| WO | WO 9311402 | A1 * | 6/1993 | F41H/11/16 |

* cited by examiner

*Primary Examiner*—Michael Carone
*Assistant Examiner*—Troy Chambers
(74) *Attorney, Agent, or Firm*—Richard C. Litman

(57) ABSTRACT

An anti-mine unit or assembly is adapted for being mounted to a prime mover or transport vehicle to reduce the dangers when clearing minefields. The anti-mine unit includes a frame, a plurality of digging cables, a plurality of drag cables, at least one side curtain of curtain cables, a rear curtain of curtain cables, and a top plate. The anti-mine unit may include a wire cutting device and a plurality of deflector cables. Heavy tubes of thick sidewalls are welded together to form the frame from which heavy cables are supported. The digging cables, drag cables, curtain cables and deflector cables are secured to the frame such that the cables, frame, and thick top plate form a unit that digs up, exposes and/or explodes mines, keeps the explosions and shrapnel controlled, and clears a pathway for the vehicle's drive wheels or tracks.

18 Claims, 9 Drawing Sheets

ANTI-MINE UNIT

CROSS-REFERENCE TO RELATED APPLICATION

This application claims the benefit of U.S. Provisional Patent Application Ser. No. 60/402,546, filed Aug. 12, 2002.

BACKGROUND OF THE INVENTION

1. Field of the Invention

The present invention relates to an anti-mine unit or assembly of very robust construction that will explode anti-personnel mines and will dig up, expose, exhume and/or explode anti-tank mines. The detonation of the mines is done under a complex cover of cables and plates in order to absorb and deflect shrapnel and blast.

2. Description of Related Art

Land mines are one of the weapons in the arsenal of modern warfare. There are land mines designed for different purposes, e.g., anti-personnel, anti-tank, etc. In time of war, it is frequently necessary to clear a minefield for the construction of an airfield, or to at least clear a path through the minefield for an advance. Minefields are often not completely cleared during wartime, and quite frequently civilians are injured by an exploding land mine years after the combat is over. Clearing minefields is hazardous duty. Several devices have been developed in an effort to clear minefields efficiently while reducing casualties which may otherwise occur while clearing minefields.

For example, U.S. Pat. No. 655,584, issued Aug. 7, 1900 to Schwartz, describes a combined roller and harrow consisting of a frame rotatably supporting a sectional or two-part roller and having a cross-strip detachably secured thereto at the rear.

U.S. Pat. No. 731,146, issued Jun. 16, 1903 to Wilmeth, describes a combined agricultural machine for multiple services in the tilling of soil. The invention provides for the operation of soil-working bits or members in a circular or rotative manner.

U.S. Pat. No. 1,102,326, issued Jul. 7, 1914 to Dalsing, describes a plow having means for swinging the cultivator blades laterally in and out between rows of plants so that the ground may be cultivated between the rows.

U.S. Pat. No. 1,679,628, issued Aug. 7, 1928 to Roby, describes an attachment mechanism between a plow and drill that insures proper travel of the drill, as well as permitting sharp turning thereof when necessary.

U.S. Pat. No. 2,920,405, issued Jan. 12, 1960 to Cole, describes a combination grading tool comprising a rake carrying frame member adapted to be hitched to a tractor for suspension from the rear thereof and a scarifier unit.

U.S. Pat. No. 2,964,863, issued Dec. 20, 1960 to Shepherd, describes a machine with movable trunnions. Various implements, such as a bulldozer blade, a ripper, a scraper blade, a push-loading scraper, a backfilling blade, or the like, may be provided.

U.S. Pat. No. 3,260,003, issued Jul. 12, 1966 to Rolfe, describes a bulldozer or like implement for attachment to a tractor.

U.S. Pat. No. 4,593,766, issued Jun. 10, 1986 to Gossard, describes a crawler tractor with a dozer blade and fitted with accessories to loosen the ground in the strafing pit area of a gunnery range and simultaneously remove from the ground rocks the size of a man's fist and larger and spent projectiles. The tractor is provided with an electromagnet positioned ahead of the dozer blade. Positioned to the rear of the tractor is a chisel bar with a plurality of chisel blades. Just ahead of the chisel bar is a rock rake that is supported with its tines at such an angle that their tips barely scrape the surface of the earth. Ahead of the rock rake, there is a drag consisting of a section of railroad rail suspended from the drawbars of the chisel assembly at a height sufficient to just scrape the surface of the ground during operation of the tractor.

U.S. Pat. No. 4,667,564, issued May 26, 1987 to Schreckenberg, describes an apparatus for clearing land mines that is provided with clearing elements which can freely move up and down independently of one another, and which are disposed in a movable carrier which is embodied as an attachment for a tracked or wheeled vehicle. Each clearing element is a small, rigid clearing plate having a supporting arm, which is suspended on a support associated with the movable frame, and is movable about a horizontal pivot axis which extends transverse to the direction of travel. The supporting arms of all of the clearing plates are the same length. All of the clearing plates, without contacting one another and at a slight distance from one another, are disposed in a compound arrangement which is parallel to the support and is arranged behind the latter in the direction of travel. The compound arrangement is either V-shaped, having its point facing in the direction of travel, or extends continuously at an angle to the direction of travel.

U.S. Pat. No. 5,183,119, issued Feb. 2, 1993 to Wattenburg, describes an anti-snag plowing system suitable for clearing mines. The plowing system comprises several digging-knife units, or plows, and a harrow. Both are attached in tandem to a chain matrix, which is pulled with either a helicopter or tractor. The digging-knife units rotate if the digging-knives hit an immovable snag. The harrow is covered with a chain blanket, and may have magnetic or sonic wave mine triggers if the system is used for clearing mines.

U.S. Pat. No. 6,330,920, issued Dec. 18, 2001 to Wanner, describes a mine stripper with numerous plow blades that rotate as they dig deeper to achieve an equilibrium depth of about nine inches and a basket that presses against the top of these blades to receive dislodged mines while sifting away attached soil.

WO93/11402, published Jun. 10, 1993 to Aardvark Clear Mine Limited, describes an apparatus for clearing mines. The apparatus includes a support on which is mounted a first impact device, such as a flail rotor. Also mounted on the support are a number of ground engaging members, each of which are adapted to extend below the surface of the ground being cleared so that when the support is moved across the surface, the members expose mines in their path. After being exposed, the first impact device generates an impact on the exposed mines.

None of the above inventions and patents, taken either singly or in combination, is seen to describe the instant inventions as claimed.

SUMMARY OF THE INVENTION

The invention is an anti-mine unit or assembly for use with a tractor, bulldozer, or other implement that will explode anti-personnel mines and will dig up, expose and/or explode anti-tank mines. Heavy tubes having thick sidewalls, e.g., ¾" thick, are welded together to form a frame from which heavy cables are supported. The heavy cables may be cut from 2" and 3" cables normally used in drag lines and other very heavy equipment. Digging cables, drag cables, curtain cables and deflector cables are attached to the frame with a thick top plate, e.g., ¾" thick steel plate, to dig up, expose and/or explode anti-tank mines, explode anti-personnel mines, keep the explosions and shrapnel controlled, and clear a pathway for the vehicle's drive wheels or tracks.

The cables are arranged so that as the vehicle moves forward, a row of cables having digging blades penetrates the ground, then a row of drag cables having ground engaging blades rides over the ground detonating mines by contact and by weight. A pair of deflector cables is suspended from the frame in front of each track or front wheel to move any unearthed and undetonated mines out of the path of the vehicle's tracks or wheels. Curtain cables are suspended from the sides and rear of the frame and, together with the top plate, serve to diminish the force of detonations to protect the vehicle, the operator of the vehicle, and nearby personnel.

Accordingly, it is a principal object of the invention to provide an anti-mine unit for safe reduction of mines in minefields.

It is another object of the invention to provide an anti-mine unit that protects personnel assigned to dig up and/or explode mines in a minefield.

It is a further object of the invention to provide an anti-mine unit that not only explodes anti-personnel mines but dig ups anti-tank mines.

Still another object of the invention is to provide an anti-mine unit that will be able to withstand the shock of exploding mines, and still be useful to continue the minefield reduction without the need for placing individuals at risk to sweep the mines.

It is an object of the invention to provide improved elements and arrangements thereof in an anti-mine unit for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an anti-mine assembly or unit 100 adapted for being mounted to a heavy equipment vehicle or other prime mover for digging up, exposing and/or safely exploding mines, such as anti-personnel mines and heavy mines like anti-tank mines. The anti-mine unit 100 includes a frame, a plurality of digging cables, a plurality of drag cables, at least one side curtain, a rear curtain, and a top plate. The anti-mine unit 100 also has a pair of deflector cables mounted in front of the vehicle's tracks or front wheels, and may optionally one or more wire cutters mounted on the front of the frame.

Figure 1:
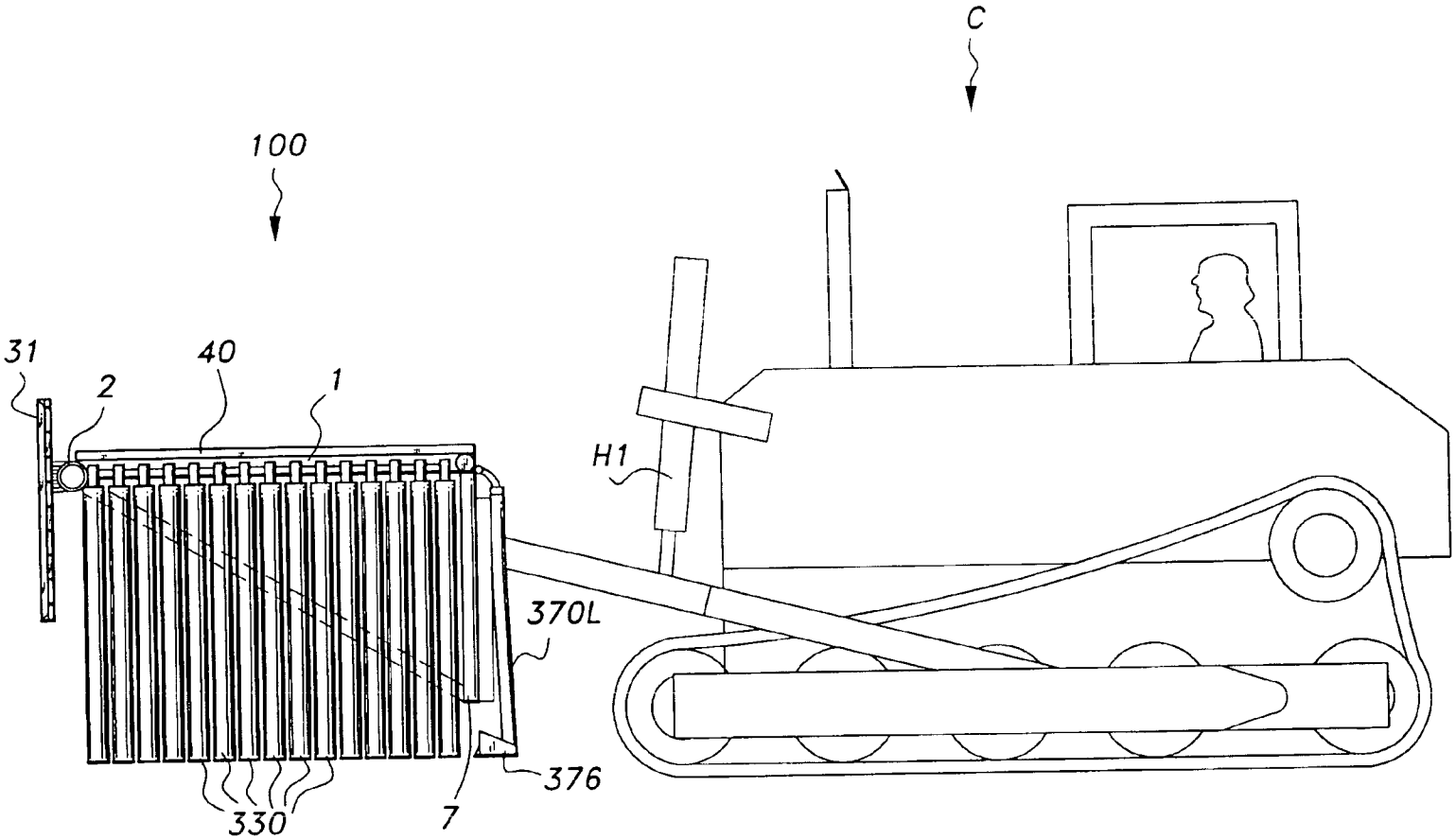
FIG. 1 is an environmental side view of an anti-mine unit according to the present invention mounted on a bulldozer.

In FIG. 1, the frame 1 of the anti-tank unit 100 is shown mounted to a bulldozer C upon the hydraulically operated hoist H1 in place of the bulldozer blade. Normally, bulldozers have caterpillar tracks, as shown. The anti-mine unit 100 may also be mounted or placed upon other heavy equipment, such as tractors, front end loaders, tanks, scout cars, armored personnel carriers, tank retrievers, and others. For example, the anti-mine unit 100 may be mounted on a tracked front end loader, or a hydraulic excavator, with a quick hitch plate and a hydraulic swivel, the front end loader having the bucket removed and the operator cab well protected. The frame 1 preferably extends substantially or entirely across an end of the prime mover, and may be welded of 5" round stock material of abnormally thick sidewalls, e.g., ¾" thick steel, to have sufficient strength to withstand explosions from exploding mines. It is also considered feasible that square or rectangular stock material may be used, but round or cylindrical stock material, such as a pipe, is more easily accessible.

Figure 2:
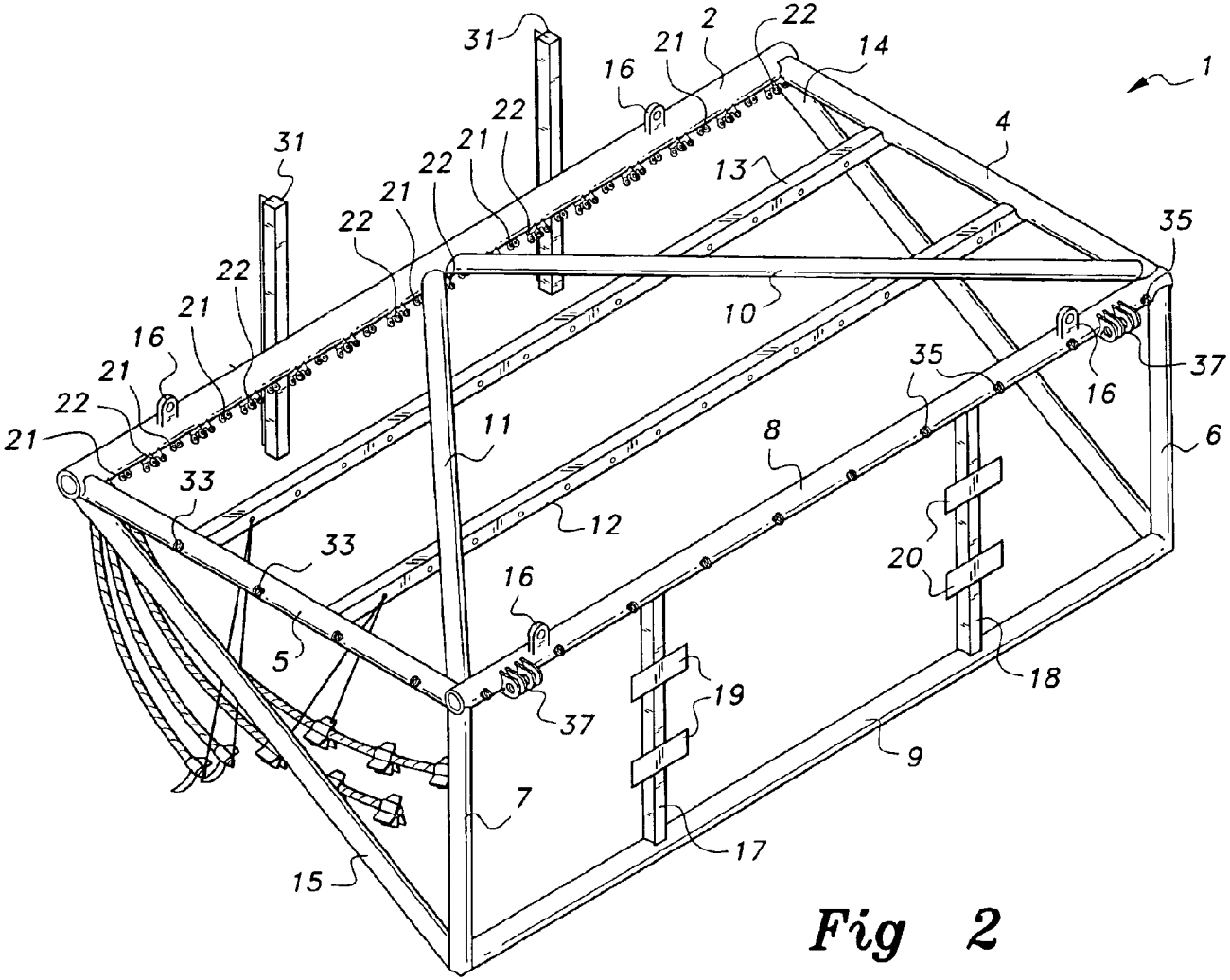
FIG. 2 is a perspective view of the frame of the anti-mine unit with the top plate, rear curtain and side curtains removed.

As shown in FIG. 2, the frame 1 has a front, beam 2, an upper rear beam 8, a lower rear beam 9, upper right and left side beams 4,5 extending from the front beam 2 to the upper rear beam 8, lower right and left side beams 14,15 extending diagonally from the front beam 2 to the lower rear beam 9, right and left vertical rear beams 6,7 extending from the ends of the upper rear beam 8 to the corresponding ends of the lower rear beam 9, and mounting beams 17,18 extending from the upper rear beam 8 to the lower rear beam 9 parallel to and between vertical rear beams 6 and 7.

Front beam 2, upper rear beam 8, and upper side beams 4 and 5 define a substantially rectangular support on which the top plate 40 is mounted. Upper side beam 5, lower side beam 15, and vertical rear beam 7 defines a substantial triangular shape, as does upper side beam 4, lower side beam 14, and vertical rear beam 6, in order to rigidly support front beam 2 in an elevated position at the front end of the anti-mine unit 100.

The front beam 2 is preferably of large diameter, such as ten inches, in order to provide more and better area for the many welds that will be placed upon it, such as attachment of the front wire cutters 31. Each of the mounting rear beams 17,18, generally not less than ¾" thick, has mounts 19,20, respectively, for mounting the frame 1 to the prime mover. The frame 1 also has a plurality of lifting eyes 16 positioned on the front beam 2 and upper rear beam 8 to permit a lifting machine or vehicle to lift the frame 1 onto or off of the prime mover.

Figure 11:
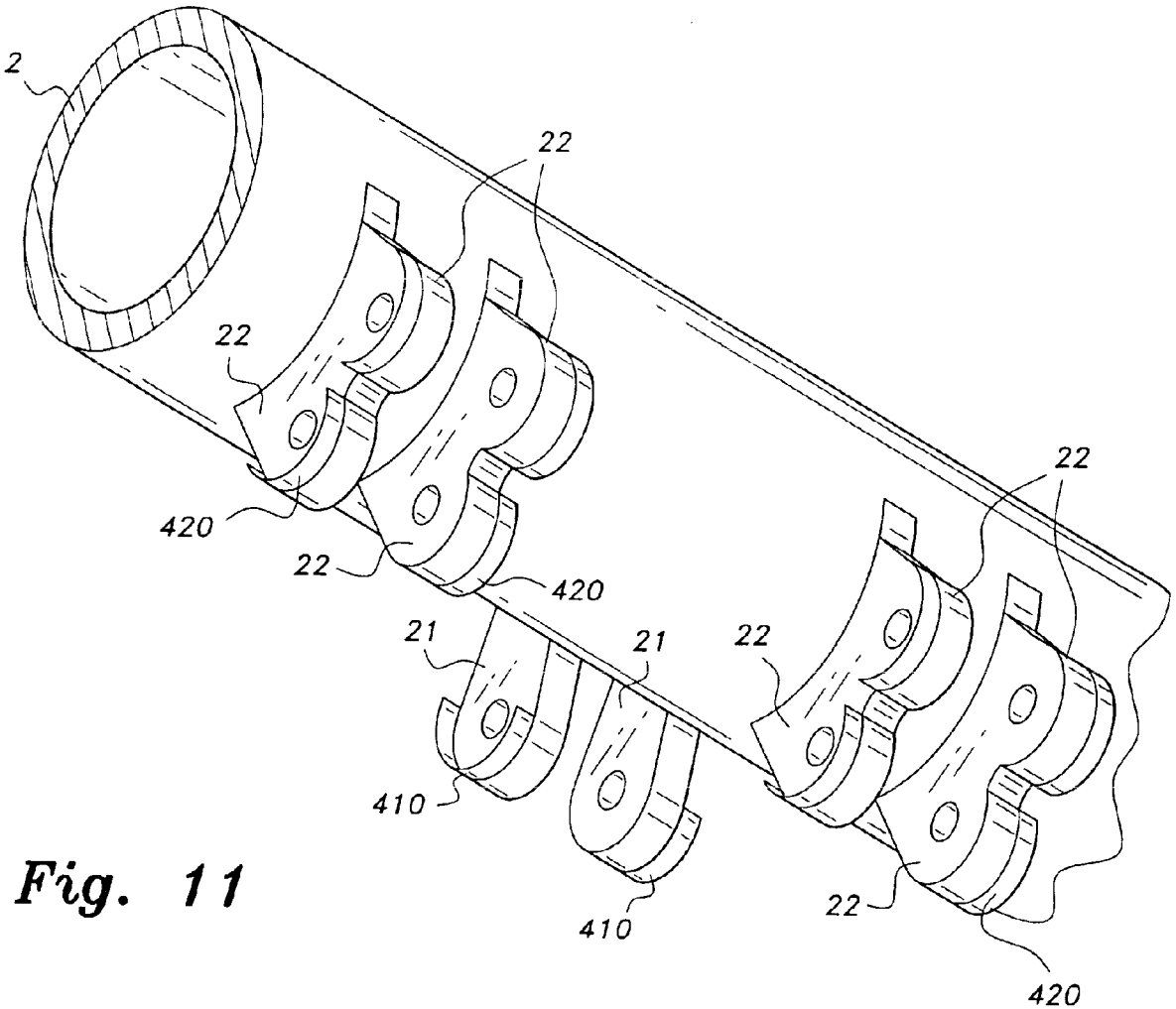
FIG. 11 is a fragmented perspective view, partly in section, of the front beam of the anti-mine unit of the present invention showing staggering of the digging and drag cable brackets.

FIG. 11 shows a portion of the front beam 2 in greater detail. The front beam 2 has a plurality of digging cable shackles 21 and drag cable shackles 22 attached thereto by welding. Each shackle 21, 22 is defined by an opposing pair of links or lugs having aligned apertures defined therein for receiving a shackle bolt or pin. It will be noted that the drag cable shackles 22 have two pairs of apertures defined therein, the upper pair for receiving a drag cable, the lower pair for receiving a digging cable. The digging cable shackles 21 may have a half-moon support 410 welded below the aperture for supporting the shackle pin, and the drag cable shackles 22 may have a similar half-moon support 420 welded below the aperture for the same purpose. The digging cable shackles 21 and drag cable shackles 22 are mounted in alternating fashion and are staggered or offset radially in order to facilitate insertion and removal of the shackle pins for quick removal and replacement of the cables, while permitting close placement of adjacent cables.

Figure 3:
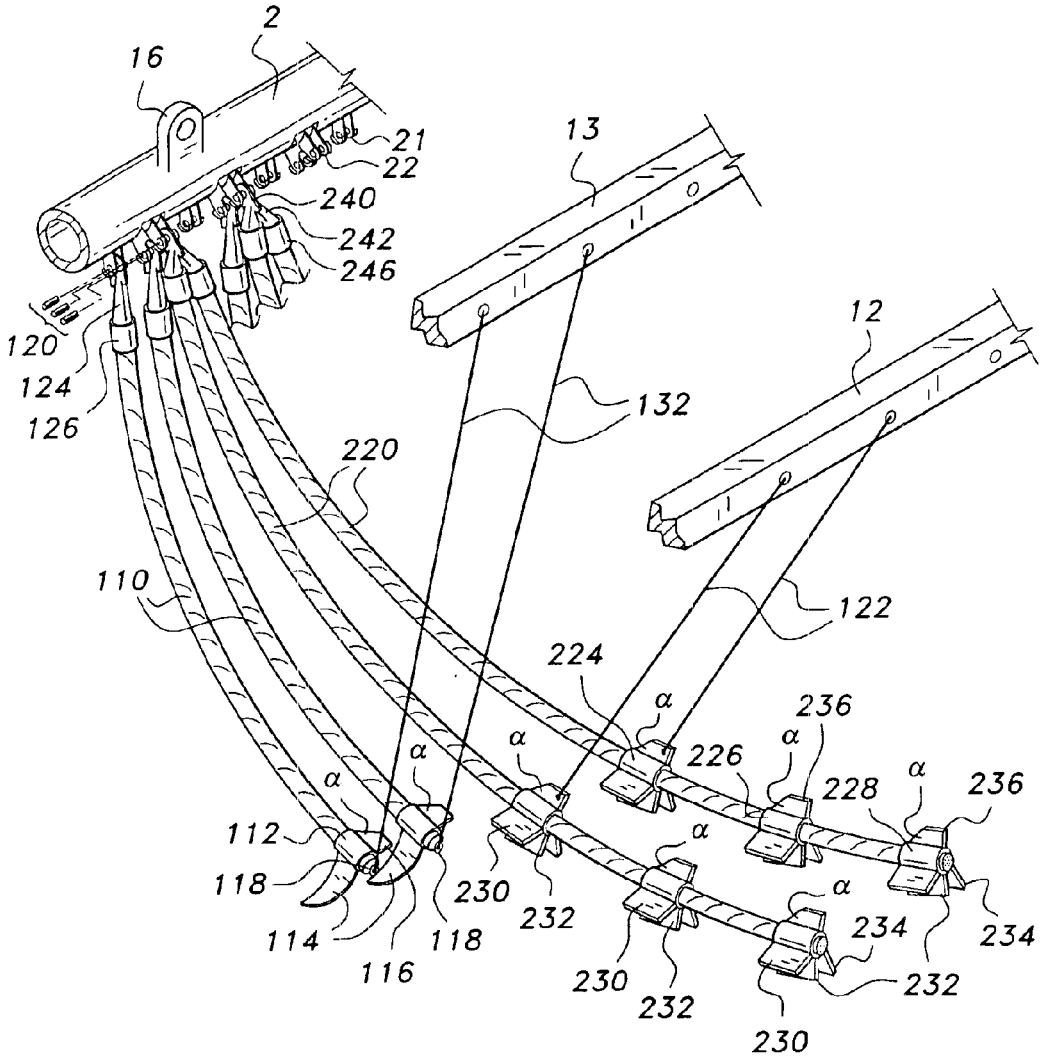
FIG. 3 is a fragmented perspective view, partly in section, of the front portion of the frame of the anti-tank unit showing attachment of the digging and drag cables.

As best shown in FIGS. 2 and 3, the top of the frame 1 is supported by the diagonal braces 10,11 extending from the center of front beam 2 to the rear corners of the upper frame. The diagonal braces 10, 11 are supported by the drag cable support beam 12 and the digging cable support beam 13, which extend between upper side beams 4 and 5. Drag lift cables 122 are attached to drag cable support beam 12, while digging lift cables 132 are attached to digging cable support beam 13. The drag lift cables 122 and digging lift cables 132 will prevent the drag cables 220 and digging cables 110, respectively, from flaring out in front of the front beam 2 and possibly missing a ground mine if a mine is detonated under the assembly and top plate 40.

To help dig through soil and rock, the digging cables 110 are sufficiently flexible to accommodate corrections to the right or left made by the prime mover. The digging cables 110 move upward and downward to follow the contour of the ground. Referring to FIG. 3, the digging cables 110 are detachably secured to the front beam 2 by the digging cable shackles 21 and the lower apertures (not numbered) of the drag cable shackles 22. One of each pair of the digging cables 110 is attached to a corresponding digging cable shackle 21, while the other of each pair is attached to the lower aperture of an adjacent corresponding drag cable shackle 22. There are thirty-one pairs of digging cables 110 secured by 1¼" pins 120 through the apertures in the shackles 21,22 for a ten foot long front beam 2. The digging cables 110 are offset to permit the removal of the pins 120 for replacing digging cables 110 that are damaged by mine explosions, as described above.

Each digging cable 110, being of 3" diameter, is welded to digging cable head 124 by digging cable head cap 126. The welding is effected by use of stainless steel, such as "308-16" rods. The ground end of each digging cable 110 has an end cap 112 welded to the cable 110, and welded to the end cap 112 is a digger blade 114 and an upper blade 116. As needed or desired, extra weight (not shown) may be added to each digging cable 110 to permit the digging cables 110 to perform effectively in hard, rough or muddy terrains. An example would be adding a block or weighted sleeve, such as a ½", ¾" or 1" steel sleeve, or a bar, such as a 2" by 4" steel bar, to each end cap 112.

The digger blade 114 needs to be of sufficient length and thickness, such as eight inches long by ¾" thick, to effectively penetrate into and dig below the ground or ground level in order to make contact with and exhume, expose and/or explode mines that lie below the ground or ground level. When desired, such as when there are no known anti-tank mines in a minefield, and explosion of anti-personnel mines is all that is required, the digging cables 110 can be turned over to allow the upper blade 116 to engage the ground directly.

The upper blade 116 is cut back at the angle $\alpha$ of about 40° with respect to an axis normal to end cap 112 in order to reduce stresses when going through brush or high grass, and to allow the digging cables 110 to reach the ground and any hidden detonators. At the end of each digging cable 110, there is a lift cable eye 118, to which a corresponding digging lift cable 132 is attached. The digging lift cables 132 are intended to keep the digging cables 110 under the front beam 2 despite any tilting or stress placed upon the anti-mine unit 100.

Similar to the digging cables 110, the drag cables 220 are sufficiently flexible to accommodate corrections to the right or left made by the prime mover, and move upward and downward to follow the contour of the ground. The drag cables 220 generally do not push soil or rock, and can work in mud or underwater.

The drag cables 220 are used in pairs, and each of the fifteen pairs is detachably secured to the front beam 2 by a pin 120 through the upper aperture (not numbered) of a corresponding drag cable shackle 22. A blade or lug 240 fits between the pair of apertures in each drag cable shackle 22, and is welded to two arms 242, which are in turn welded to two caps 246, which are in turn welded to the cables of the pair of drag cables 220. The drag cables 220 may be a little thinner, e.g., two inches in diameter, than the digging cables 110, but welds are still by stainless 308-16 stock material or welding rods.

Three steel sleeves 224,226,228, of ½" thickness, are positioned upon each drag cable 220, and each sleeve 224,226,228 has ground engaging blades 230,232,234, which are intended to contact the ground and any detonators at or slightly below ground level. On the other side of the ground blades 230,232,234, a grass blade 236 is welded upon each sleeve 224,226,228 to permit the drag cables 220 to be turned over for penetration of high grass, brush or hay, and is recessed at an angle $\alpha$ of about 40° in order to better penetrate.

A drag lift cable 122 is attached to an aperture in one of the grass blades 236 of a drag cable 220 in order to ensure that the drag cables 220 maintain appropriate orientation. As needed or desired, extra weight (not shown) may be added to each drag cable 220 to permit the drag cables 220 to perform effectively in hard, rough or muddy terrains. An example would be adding a block or weighted sleeve, such as a ½", ¾" or 1" steel sleeve, or a bar, such as a 2" by 4" steel bar, to one of the sleeves 224,226,228 of each drag cable 220.

As shown in FIGS. 1–2 and 6–8, both of the sides and the rear of the anti-mine unit 100 have a curtain (not numbered) of 2" curtain cables 330 in close proximity to one another. These curtain cables 330 provide protection to the prime mover and personnel in the vicinity from shrapnel and flying dirt and rocks caused by mine explosions beneath the top plate 40 by keeping the dangers in a confined area. The right and left side curtains are mounted upon the upper side beams 4,5, respectively, using the side curtain hangers 33, and the rear side curtain is mounted upon the upper rear beam 8 using the rear curtain hangers 35.

Figure 8:
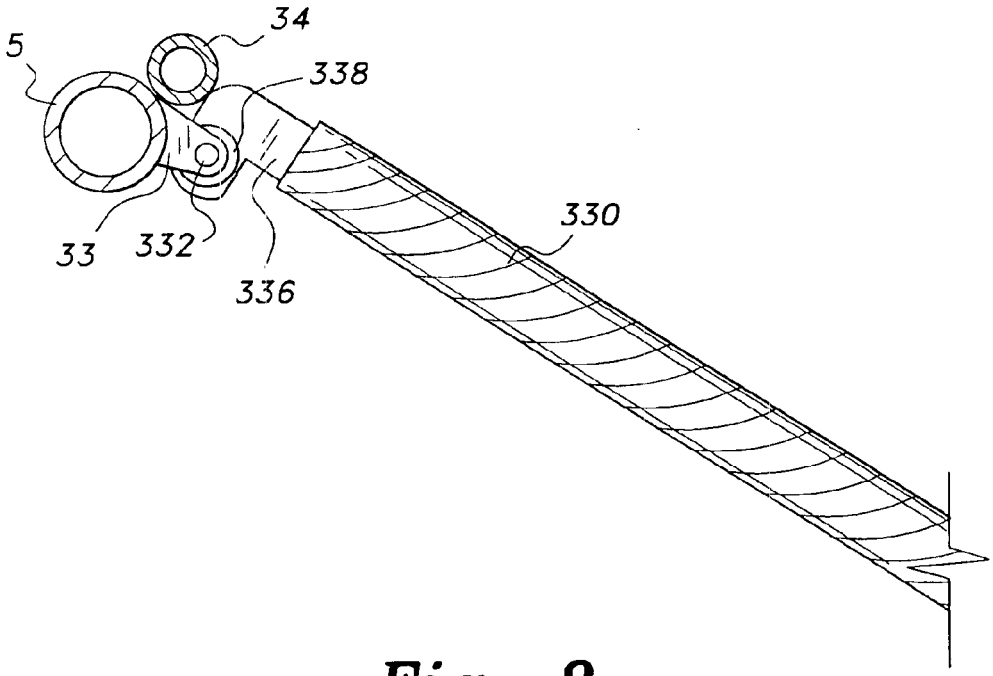
FIG. 8 is a side view, partly in section, showing the relation of a curtain cable to the frame of the anti-mine unit of the present invention when under stress from an explosion.

Extended pin 332 mounts the curtain cables 330, which are each welded to an elbow 336. Elbow 336 is of ¾" steel sheet cut to size and shape. Washers 338 are welded to elbows 336 to space the cables 330 and allow free rotation of the elbows 336. Five curtain cables 330 are placed every ten inches. As the curtain cables 330 will be placed under strain during explosions, they will be expected to fly outward. As shown in FIG. 8, a heavy tube 34, which may be a solid rod, may be welded to the upper side beams 4,5, and will keep the curtain cables 330 at or below 70° from vertical and facilitate shrapnel being forced into the ground and the recovery of the curtain cables 330. The curtain cables 330 will generally flex when they come in contact with the ground or rocks.

Figure 4:
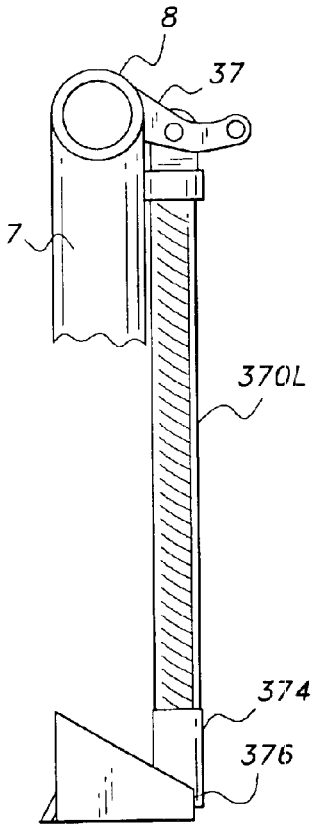
FIG. 4 is a side view of a deflector cable of the anti-tank unit of the present invention.
Figure 5:
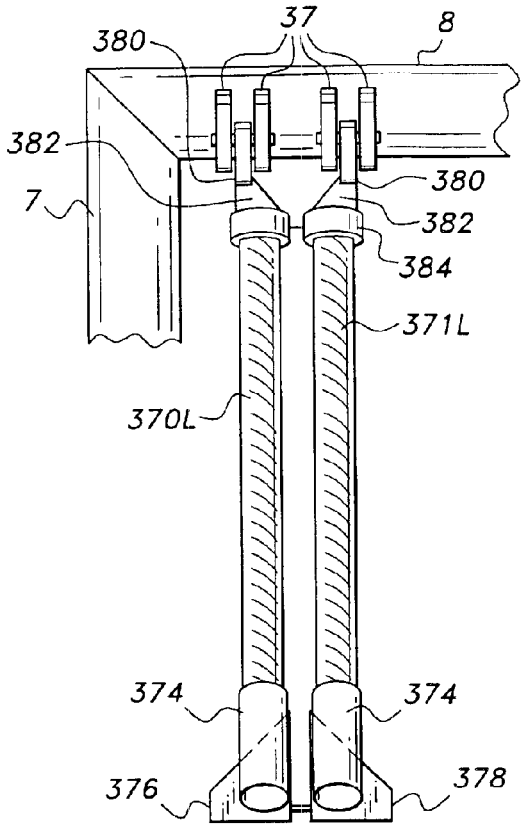
FIG. 5 is a fragmented rear view showing two adjacent deflector cables of the anti-tank unit of the present invention.
Figure 7:
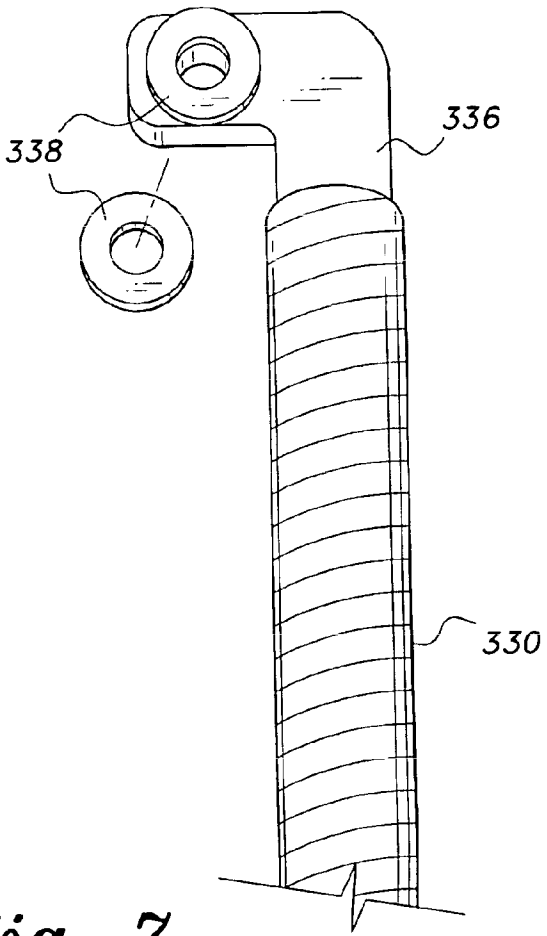
FIG. 7 is a fragmented perspective view of the top portion of a curtain cable of the anti-tank unit of the present invention.
Figure 6:
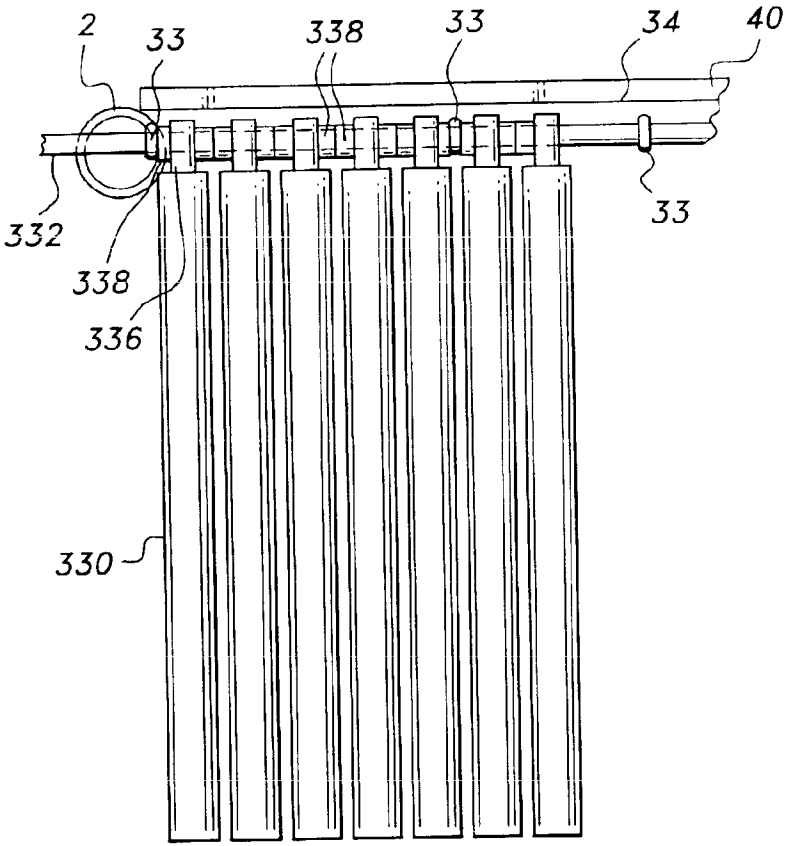
FIG. 6 is a fragmented side view of the left side curtain of the anti-tank unit of the present invention, partially assembled.

Just in front of the track or tires of the prime mover are the deflector cables 370L,371L (as best shown in FIGS. 4 and 5), which are 3" cables that are intended to sweep exhumed and unexploded anti-tank mines from the path of the track/wheels of the prime mover. The deflector cables 370L,371L are sufficiently flexible to accommodate corrections to the right or left made by the prime mover.

The upper rear beam 8 has deflector cable shackles 37 welded thereto. The deflector cables 370L,371L are welded to caps 384, which are in turn welded to arms 382, which are in turn welded to blade or lug 380, the blade 380 being affixed to the shackle 37 by a pin (not numbered) similar to the pin 120 mentioned above. The deflector cables 370L, 371L are relatively hefty and stiff but have end caps 374 welded thereto. Plows 376,378 are welded to the end caps 374. Unlike ground plows, plows 376,378 are not intended to turn earth, but are generally trapezoidal with a horizontal, linear bottom edge for scraping the earth to move any exhumed land mines, especially anti-tank mines, away from the tracks or wheels of the prime mover.

A pair of deflector cables 370L,371L are mounted on each side of the rear of frame 1 to provide the greatest possible protection for the prime mover. It is preferred that each pair of deflector cables 370L,371L are bolted together at the bottom to prevent the pair from spreading apart.

Figure 10:
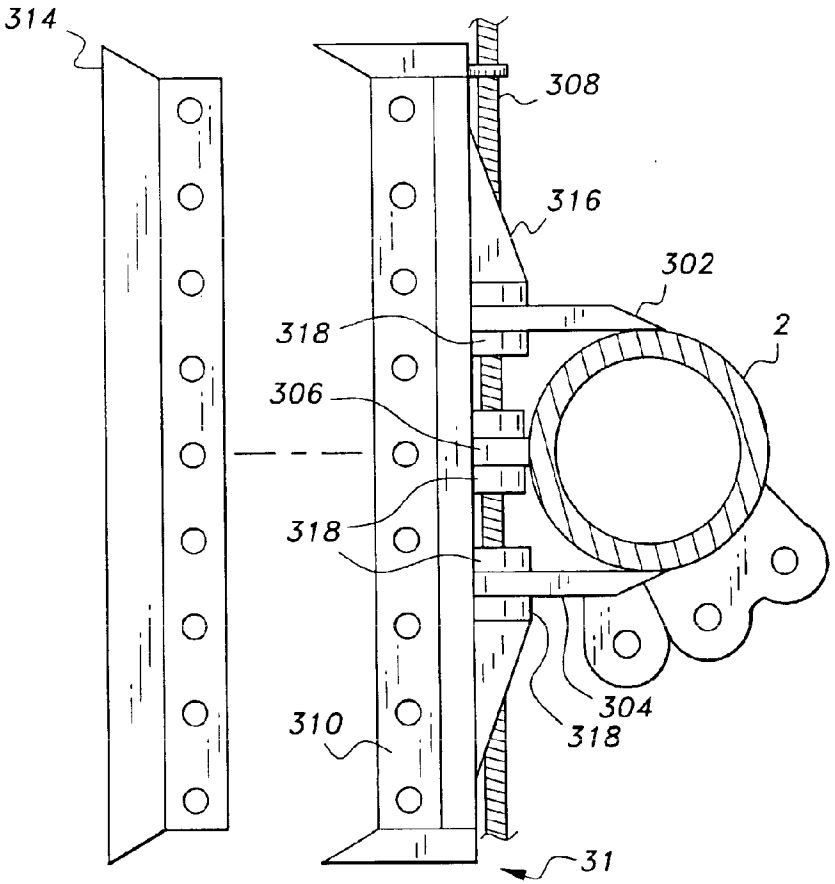
FIG. 10 is a side view of one of the wire cutters attached to the front beam of the anti-mine unit of the present invention.
Figure 9:
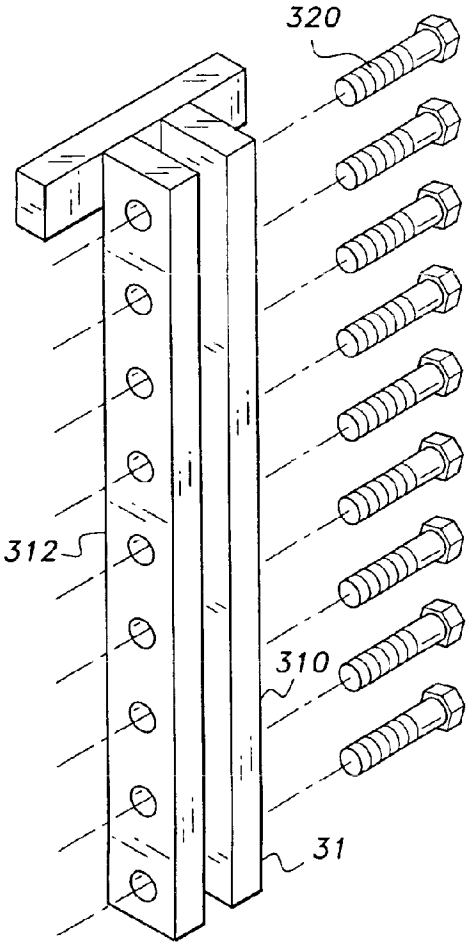
FIG. 9 is a front perspective view part of a wire cutter blade holder bracket of the anti-mine unit of the present invention.

FIGS. 9 and 10 are directed to wire cutters 31 which may optionally be mounted to front beam 2. Wire cutters are seen to be important, as most mine barriers are surrounded by wire to keep people out (false minefields, wire with signs only, will often be very successful in keeping enemy assaults from being sent through very accessible terrain). Inexpensive and versatile, a wire cutter 31 is comprised of a blade holder having right and left sides 310,312 and a blade 314. Wire cutter mounts 302,304,306 are mounted upon the front beam 2. Cutter braces 316,318 are welded to the rear of the blade holders and removably attached to the mounts 302, 304,306 by a long bolt 308, while the blade 314 of the wire cutter 31 is removably attached to the blade holder by a plurality of bolts 320.

Figure 12:
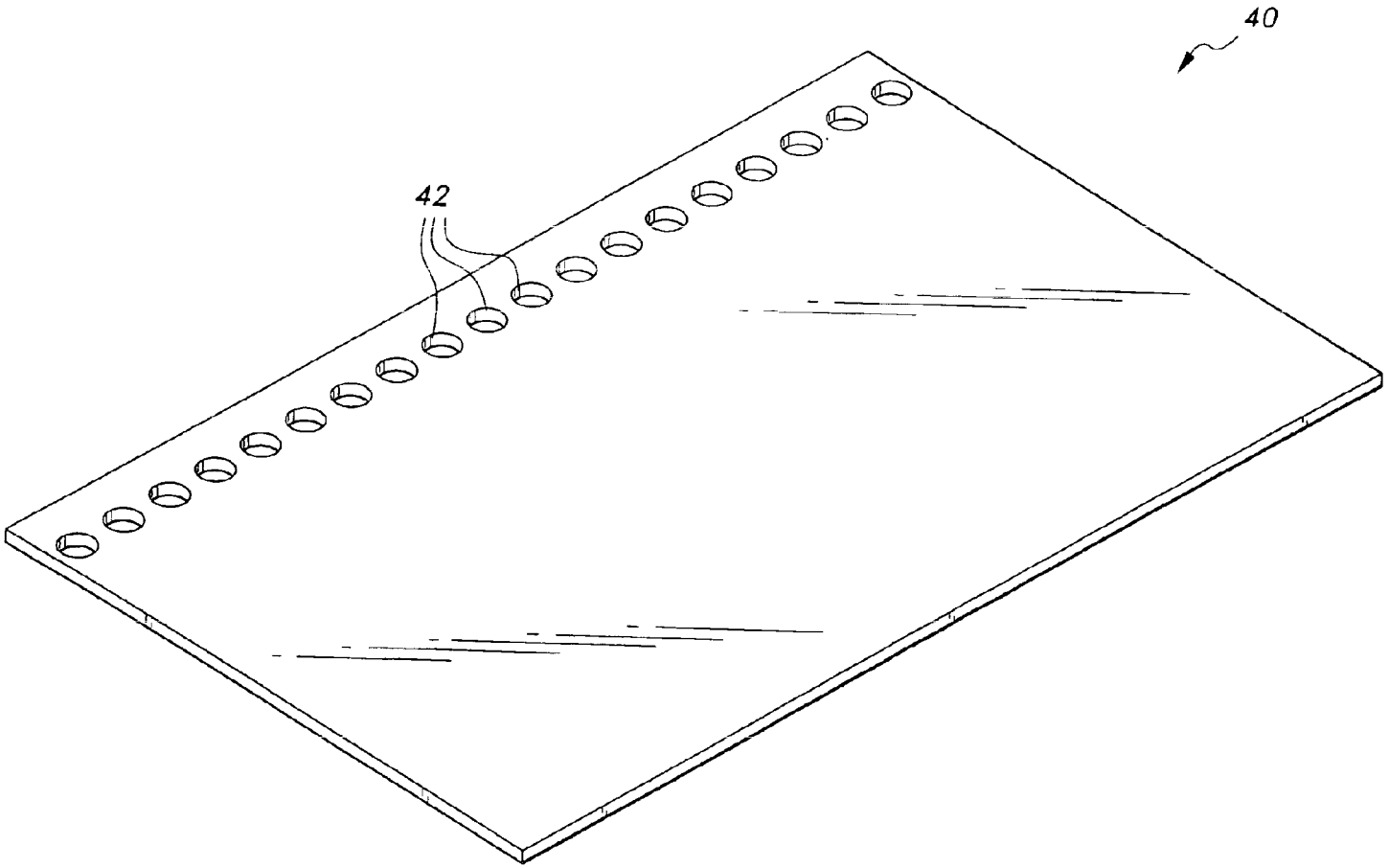
FIG. 12 is a perspective view of the top plate of the anti-mine unit of the present invention.

As shown in FIGS. 1 and 12, the top plate 40 is rigidly secured, such as by welding, upon the top of the frame 1 such that the top plate 40 is prevented from flying off of the assembly after a mine explosion. The top plate 40 substantially or entirely covers the top of the frame 1, and may be of a size, such as 5' by 10', that fits within the area defined by the lifting eyes 16, as shown in FIG. 2. The top plate 40 has a plurality of holes 42, preferably about two inches in diameter, to permit damaged digging and drag cables 110, 220 to be detached and replaced without difficulty, and to allow chains or cables to be passed therethrough for lifting the drag cables 220. Steel washers (not shown), about ½" thick, may be welded to the underside or on top of the holes 42 to prevent the holes 42 from being damaged or split after a mine explosion. The top plate 40 may be ¾" thick and will be effective in reducing shrapnel and "bouncing betty" type mines from injuring nearby personnel.

This anti-mine unit 100, mounted upon a tracked or wheeled prime mover, is able to quickly and easily reduce a minefield of anti-personnel mines. Anti-tank mines can be exhumed and gathered, easily and safely. Any anti-tank mines that are booby-trapped to explode upon removal can be exploded under a very hefty and stout assembly that will yield with the blast and still retain integrity, even if some of the individual cables are damaged. Though it is advisable to provide a prime mover with armored cab, to protect the operator, very little shrapnel or blast debris should cause damage to personnel to the rear or sides, even though they should be removed by at least fifty yards or meters.

Though the anti-mine unit 100 is designed to not miss any mines by the overlap of the various cables, the minefield should be swept by other personnel. It goes without saying that with the anti-mine unit 100 detonating the vast majority of mines in the field, if not all, risk to sweeping personnel is greatly reduced.

It is to be understood that the present invention is not limited to the embodiments described above, but encompasses any and all embodiments within the scope of the following claims.

I claim:

1. An anti-mine unit for digging up, exposing and exploding mines in a minefield, comprising:

a front beam, a rear beam, and two opposing side beams defining a rectangular frame;

mounting means normal to the rear beam for mounting the rectangular frame to a prime mover so that the frame extends horizontally in front of the prime mover;

a plurality of digging cables suspended from the front beam adapted for digging into a surface of the minefield, each cable being independently suspended;

a plurality of drag cables suspended from the front beam adapted for dragging over the surface of the minefield, each dragging cable being independently suspended;

a plurality of curtain cables suspended from the rear beam and the two opposing side beams;

a first pair of deflector cables and a second pair of deflector cables mounted to opposite ends of the rear beam, respectively, the deflector cables being adapted for deflecting unexploded mines from a path of the prime mover.

2. The anti-mine unit of claim 1, further comprising a top plate affixed to said rectangular frame and covering an opening defined by said rectangular frame, said top plate and said curtain cables minimizing blast damage from mines exploded by the anti-mine unit.

3. The anti-mine unit of claim 2, wherein said top plate has a plurality of holes defined therein adapted for passing a flexible element therethrough for lifting said drag cables.

4. The anti-mine unit of claim 1, wherein each said digging cable further comprises an end cap having a digger blade extending therefrom adapted for penetrating the surface of the minefield attached to an end of the digging cable.

5. The anti-mine unit of claim 4, wherein each said digging cable further comprises a shallow ground engaging blade attached to said end cap about 180° opposite said digger blade.

6. The anti-mine unit of claim 1, wherein each said digging cable comprises a three inch diameter steel cable.

7. The anti-mine unit of claim 6, wherein of said drag cables further comprises a plurality of sleeves disposed thereon, each of said sleeves having a plurality of ground engaging blades extending therefrom adapted for dragging across a minefield and detonating shallow mines.

8. The anti-mine unit of claim 7, wherein each of said drag cables further comprises a grass blade attached to said sleeves adapted for penetrating tall grass.

9. The anti-mine unit of claim 1, wherein each of said drag cables comprises two inch diameter steel cable.

10. The anti-mine unit of claim 1, wherein said curtain cables comprise two inch diameter steel cables spaced five said cables per ten inches of beam.

11. The anti-mine unit of claim 1, wherein further comprising an elongated rod attached to each said side beam, said elongated rod limiting outward rotation of said curtain cables to 70° from vertical.

12. The anti-mine unit of claim 1, wherein said each said deflector cable comprises three inch diameter steel cable.

13. The anti-mine unit of claim 1, wherein each said deflector cable further comprises an end cap having a plow blade attached thereto.

14. The anti-mine unit of claim 13, wherein each said deflector cable is bolted to an adjacent said deflector cable in the pair of deflector cables at the plow blade end of said deflector cables.

15. The anti-mine unit of claim 1, wherein said frame further comprises:

right and left vertical rear beams extending normal to said rear beam and to said opposing side beams;

a lower rear beam extending between said right and left vertical rear beams parallel to said rear beam; and lower left and right side beams extending diagonally between said front beam and said lower rear beam, the opposing side beams, lower right and left side beams, and right and left vertical rear beams defining rigid triangular supports maintaining said front beam in an elevated position.

16. The anti-mine unit of claim 1, further comprising:

a digging cable support beam extending between the two opposing side beams;

a drag cable support beam extending between the two opposing side beams; and a plurality of lift cables extending between said digging cable support beam and said digging cables, and between said drag cable support beam and said drag cables, for preventing movement of said digging and drag cables forward of said front beam.

17. The anti-mine unit of claim 1, further comprising a plurality of digging cable shackles and a plurality of drag cables shackles attached in alternating fashion to said front beam, said digging cable shackles being radially staggered from said drag cable shackles, one said digging cable being removably attached to each said digging cable shackle, one said digging cable and one said drag cable being removably attached to each said drag cable shackle, whereby said digging cables and said drag cables are easily removed for repair and replacement.

18. The anti-mine unit of claim 1, further comprising a plurality of wire cutters attached to said front beam.

* * * * *